US008130967B2

(12) United States Patent
Kino

(10) Patent No.: US 8,130,967 B2
(45) Date of Patent: Mar. 6, 2012

(54) FREQUENCY-CHARACTERISTIC-ACQUISITION DEVICE, FREQUENCY-CHARACTERISTIC-ACQUISITION METHOD, AND SOUND-SIGNAL-PROCESSING DEVICE

(75) Inventor: Yasuyuki Kino, Tokyo (JP)

(73) Assignee: Sony Corporation, Tokyo (JP)

( * ) Notice: Subject to any disclaimer, the term of this patent is extended or adjusted under 35 U.S.C. 154(b) by 1189 days.

(21) Appl. No.: 11/581,648

(22) Filed: Oct. 16, 2006

(65) Prior Publication Data

US 2007/0086553 A1 Apr. 19, 2007

(30) Foreign Application Priority Data

Oct. 18, 2005 (JP) ..... P2005-302985

(51) Int. Cl.
*H04R 29/00* (2006.01)

(52) U.S. Cl. ..... 381/59; 381/58

(58) Field of Classification Search ..... 381/56–59, 381/103, 98, 17, 92, 91, 61, 63; 700/94
See application file for complete search history.

(56) References Cited

U.S. PATENT DOCUMENTS

| | | | | |
|---|---|---|---|---|
| 6,760,451 | B1 * | 7/2004 | Craven et al. | 381/98 |
| 7,158,643 | B2 * | 1/2007 | Lavoie et al. | 381/58 |
| 7,257,230 | B2 * | 8/2007 | Nagatani | 381/56 |
| 2006/0140414 | A1 * | 6/2006 | Higashihara et al. | 381/59 |

FOREIGN PATENT DOCUMENTS

| | | | |
|---|---|---|---|
| JP | 04-295727 | | 10/1992 |
| JP | 07-095684 | | 4/1995 |
| JP | 11-258034 | * | 9/1999 |
| JP | 2000-097763 | | 4/2000 |

OTHER PUBLICATIONS

Nobuharu Aoshima, "Computer-generated pulse signal applied for sound measurement", J. Acoust. Soc. Am., No. 69(5), 1981.

Yoiti Suzuki, etc., "An opt6imum computer-generated pulse signal suitable for the measurement of very long impulse responses", J. Acoust. Soc. Am. 97(2), 1995.

Yoiti Suzuki, etc. "Considerations on the Design of Time Stretched Pulses", Technical Report of IEICE, Ea92-86 (Dec. 1992).

Muller, Swen et al., "Transfer-Function Measurement with Sweeps", J. Audio Eng. Soc., Jun. 2001, pp. 443-471, vol. 49, No. 6, New York.

* cited by examiner

*Primary Examiner* — Xu Mei
*Assistant Examiner* — Lun-See Lao
(74) *Attorney, Agent, or Firm* — Wolf, Greenfield & Sacks, P.C.

(57) ABSTRACT

A frequency-characteristic-acquisition device that inputs a time-stretched-pulse signal to a system to be measured and that acquires information about a frequency characteristic of the system on the basis of a signal output from the system is provided. The frequency-characteristic-acquisition device includes a control unit which performs control so that the time-stretched-pulse signal is expanded in a time-axis direction and output to the system, and an acquisition unit that analyzes the signal output from the system and that acquires the frequency-characteristic information.

10 Claims, 10 Drawing Sheets

FREQUENCY-CHARACTERISTIC-ACQUISITION DEVICE, FREQUENCY-CHARACTERISTIC-ACQUISITION METHOD, AND SOUND-SIGNAL-PROCESSING DEVICE

CROSS REFERENCES TO RELATED APPLICATIONS

The present invention contains subject matter related to Japanese Patent Application JP 2005-302985 filed in the Japanese Patent Office on Oct. 18, 2005, the entire contents of which are incorporated herein by reference.

BACKGROUND OF THE INVENTION

1. Field of the Invention

The present invention relates to a frequency-characteristic-acquisition device and a method used therefor, where the frequency-characteristic-acquisition device acquires information about the frequency characteristic of a sound signal that is output from a speaker and that is transmitted to a microphone on the basis of a result of collecting a test signal by using the microphone. The present invention further relates to a sound-signal-processing device having the function of acquiring the frequency-characteristic information.

2. Description of the Related Art

Hitherto, in audio systems or the like reproducing and/or outputting an audio signal, a test signal such as a time-stretched-pulse (TSP) signal or the like is output from a speaker and collected by using a separately provided microphone. Further, information about the frequency characteristic of a sound signal output from the audio system is acquired on the basis of a result of collecting the test signal by using the microphone, and the frequency characteristic is analyzed.

More specifically, the TSP signal that is output from the speaker and collected by the microphone is subjected to Fourier-transform processing such as fast-Fourier-transform (FFT) processing, and the frequency-characteristic information is acquired. Then, a gain characteristic, a phase characteristic, and so forth are calculated on the basis of a result of the frequency-characteristic acquisition.

In the past, the frequency-characteristic information was acquired according to the following method. Namely, the sampling rate (an operation frequency) of a reproduction device which reproduces and/or outputs the TSP signal is determined to be Fs, and the number of samples subjected to the FFT processing (the number of samples of the TSP signal) is determined to be n. The TSP signal includes signals generated in the range of from 0 to Fs/2 Hz, where gains of the signals generated at each of intervals of Fs/n Hz are the same as one another.

For example, where the sampling rate is shown by the equation Fs=44.1 kHz and the sample number n is shown by the equation n=4096, the TSP signal includes signals generated in the frequency range of from 0 to 22.05 (44.12) kHz, where gains of the signals generated at each of intervals of about 10.8 (44100/4096) Hz are the same as one another.

When the above-described TSP signal is obtained, for example, it becomes possible to analyze the frequency characteristic of each of frequency bands included in the range of from 0 to 22.05 kHz at intervals of about 10.8 Hz.

Known technologies relating to the present invention are disclosed in Japanese Unexamined Patent Application Publication No. 2000-097763 and Japanese Unexamined patent Application Publication No. 04-295727, for example.

SUMMARY OF THE INVENTION

Here, according to the above-described known frequency-characteristic acquisition method, the value of the above-described interval relating to the TSP signal is shown by the expression Fs/n, where the interval can be used as a resolution of frequencies of an analyzable frequency band. According to the above-described configuration, however, when a low frequency band of from a few tens of Hz to a few hundred Hz is divided into narrow bands and each of the narrow bands is analyzed, the number of samples of the TSP signal, which is designated by n, should be increased.

Thus, according to the known method, the capacity of a memory holding data on the TSP signal may have to be increased, so as to analyze the frequency characteristic of the low-frequency band at short intervals. Further, since the number n of samples subjected to the FFT processing is increased, the load of processing also increases.

According to the known method, the value of sample number n is determined to be 4096 so that the value of each of the frequency intervals becomes about 10.8 Hz, which allows for analyzing the frequency characteristic of the low-frequency band at relatively short intervals. However, according to the above-described configuration, it is difficult to increase the value of the sample number n when the hardware resource of the reproduction device is poor such that the memory capacity of the reproduction device is insufficient and/or the capability for the FFT processing is low. Subsequently, the value of each of the frequency intervals increases, which makes it difficult to analyze the frequency characteristic of the low-frequency band at short intervals.

Thus, according to the known method of acquiring the frequency-characteristic information, the value of the intervals at which the frequency-characteristic-information is acquired is limited depending on the hardware resource of the reproduction device.

Accordingly, a frequency-characteristic-acquisition device according to an embodiment of the present invention has the following configuration.

The frequency-characteristic-acquisition device that inputs a time-stretched-pulse signal to a system to be measured and that acquires information about a frequency characteristic of the system on the basis of a signal output from the system includes a control unit which performs control so that the time-stretched-pulse signal is expanded in a time-axis direction and output to the system, and an acquisition unit that analyzes the signal output from the system and that acquires the frequency-characteristic information.

A frequency-characteristic-acquisition method according to another embodiment of the present invention includes the steps of transmitting a time-stretched-pulse signal expanded in a time-axis direction to a system to be measured, and analyzing a signal output from the system, so as to acquire information about a frequency characteristic of the system.

A sound-signal-processing device according to another embodiment of the present invention includes a reproduction unit which reproduces a sound signal that should be output from a speaker, a control unit that expands a time-stretched-pulse signal in a time-axis direction and that performs control so that the time-stretched-pulse signal is output from the speaker, an acquisition unit that acquires information about a frequency characteristic of an acoustic-transmission system that starts from the speaker and ends at a microphone on the basis of the expanded time-stretched-pulse signal collected by the microphone, and a sound-adjustment unit which performs predetermined adjustment for a sound signal that should be output from the speaker on the basis of a result of an analysis of the frequency-characteristic information acquired by the acquisition unit.

Thus, the TSP signal is expanded in the time-axis direction and output in the above-describe manner. When the sampling-rate value is determined to be Fs, and the sample number is determined to be n, and the value of the rate at which the TSP signal is expanded is determined to be K, the TSP signal includes signals generated in the frequency range of from 0 to Fs/2×K Hz, where gains of the signals generated at each of intervals of Fs/n×K Hz are the same as one another.

That is to say, the range of frequencies included in the TSP signal is reduced by as much as the value corresponding to the expansion rate (the reduction rate is shown by the expression 1/K). However, the value of each of the frequency intervals can be reduced by as much as the value corresponding to the expansion rate (the reduction rate is shown by the expression 1/K).

Accordingly, it becomes possible to obtain the frequency-characteristic information at short frequency intervals irrespective of the number n of samples of the TSP signal.

Subsequently, the value of each of the frequency intervals can be reduced without increasing the sample number n so that the frequency-characteristic information can be obtained at short intervals irrespective of the hardware resource of the device. According to embodiments of the present invention, the value of the range of frequencies included in the TSP signal is determined on the basis of the expression 1/K. Therefore, the present invention allows for analyzing a low-frequency band at short intervals.

Further, the above-described sound-signal-processing device allows for adjusting a sound signal that should be output from the speaker on the basis of a result of an analysis on the frequency characteristic acquired in the above-described manner.

DESCRIPTION OF THE PREFERRED EMBODIMENTS

Hereinafter, preferred embodiments of the present invention will be described with reference to the attached drawings.

Figure 1:
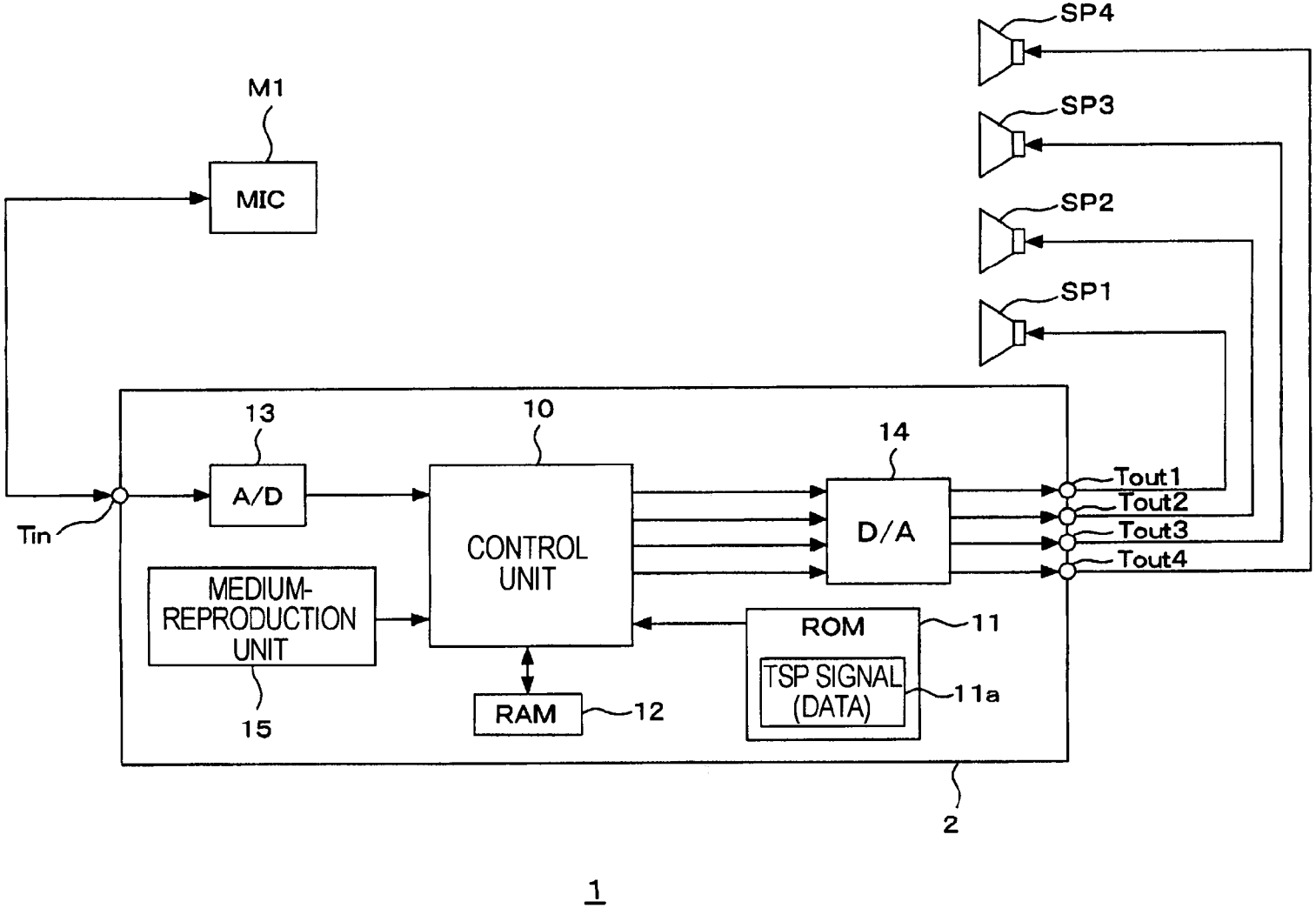
FIG. 1 is a block diagram illustrating the internal configuration of a sound-signal-processing device according to an embodiment of the present invention and the configuration of an audio system including the above-described sound-signal-processing device, speakers, and a microphone.

FIG. 1 shows the internal configuration of a reproduction device 2 performing sound-signal processing according to a first embodiment of the present invention and the configuration of an audio system 1 including the reproduction device 2.

As shown in FIG. 1, the reproduction device 2 includes a medium-reproduction unit 15, so as to reproduce data recorded onto a desired recording medium. The desired recording medium may be an optical-disk recording medium including a compact disc (CD), a digital-versatile disk (DVD), a Blu-Ray Disc, and so forth, a magnetic disk including a mini disc (MD), which is a magneto-optical disk, a hard disk, and so forth, a recording medium including a semiconductor memory, and so forth.

As shown in FIG. 1, the audio system 1 of the first embodiment includes a plurality of speakers SP1, SP2, SP3, and SP4. Each of the speakers SP1 to SP4 outputs an audio signal (sound signal) reproduced by the medium-reproduction unit 15. The audio system 1 further includes a microphone (MIC) M1 required to analyze a frequency characteristic which will be described later, as shown in FIG. 1.

The above-described audio system 1 can be used, as a car-audio system and/or a surround system with 5.1 channels, for example.

In the first embodiment, the number of the speakers provided in the audio system 1 is determined to be four, for example. However, it is essential only that the audio system 1 includes at least two speakers. Therefore, the number of the speakers is not limited to that determined in the first embodiment.

The reproduction device 2 includes a sound-input terminal Tin which transmits a sound signal collected by the microphone M1. The reproduction device 2 is connected to the microphone M1 via the sound-input terminal Tin.

Further, the reproduction device 2 has a plurality of sound-output terminals Tout1, Tout2, Tout3, and Tout4 corresponding to the plurality of speakers SP1, SP2, SP3, and SP4. The reproduction device 2 is connected to the speakers SP1 to SP4 via the output terminals Tout1 to Tout4.

The collected sound signal transmitted from the microphone M1 via the sound-output terminal Tin is transmitted to the control unit 10 via an analog-to-digital (A/D) converter 13.

Further, the control unit 10 transmits sound signals of a plurality of systems of which number is determined according to the number of the above-described speakers SP1 to SP4 to the above-described output terminals Tout1 to Tout4 via a digital-to-analog (D/A) converter 14. It should be noted that any of the sound signals is transmitted to one of the output terminals Tout1 to Tout4 according to the correspondence between the system from which the sound signal is transmitted and the output terminal.

The control unit 10 includes a digital-signal processor (DSP) and/or a central-processing unit (CPU), for example, and is configured to perform various functional operations which will be described later.

As shown in FIG. 1, the control unit 10 includes a read-only memory (ROM) 11 and a random-access memory (RAM) 12. The ROM 11 stores a program and information about a coefficient, a parameter, and so forth that are necessary for the control unit 10 to perform various control processing procedures. Particularly, in the first embodiment, the ROM 11 stores data on a time-stretched-pulse (TSP) signal 11*a*. The data on the TSP signal 11*a* is used, so as to perform a frequency-characteristic analysis which will be described later.

The TSP signal 11*a* is generated, as below. Namely, when the sampling rate (operation frequency) of the reproduction device 2 is determined to be Fs and the number of samples of the TSP signal 11*a* (the number of samples subjected to fast-Fourier-transform (FFT) processing that will be described later) is determined to be n, the TSP signal 11*a* includes signals generated in the frequency range of from 0 Hz to Fs/2 Hz, where gains of the signals generated at each of intervals of Fs/n Hz are the same with each other.

In the first embodiment, an operation-clock frequency (sampling rate) Fs of the reproduction device 2 is determined to be 44.1 kHz. Further, the number of samples of the TSP signal 11*a* is determined to be 512.

Further, the RAM 12 is used, as a work area used for storing data on operations performed by the control unit 10 temporarily, for example.

As described above, the medium-reproduction unit 15 reproduces data recorded onto the above-described recording mediums.

For example, when the optical-disk-type recording medium and/or the MD is used, as the recording medium, the medium-reproduction unit 15 includes an optical head, a spindle motor, a reproduction-signal-processing unit, a servo circuit, and so forth, so as to irradiate a disk-type recording medium loaded into the medium-reproduction unit 15 with laser lights and reproduce a signal.

Then, the medium-reproduction unit 15 transmits an audio signal obtained through the above-described reproduction operation to the control unit 10.

Figure 2:
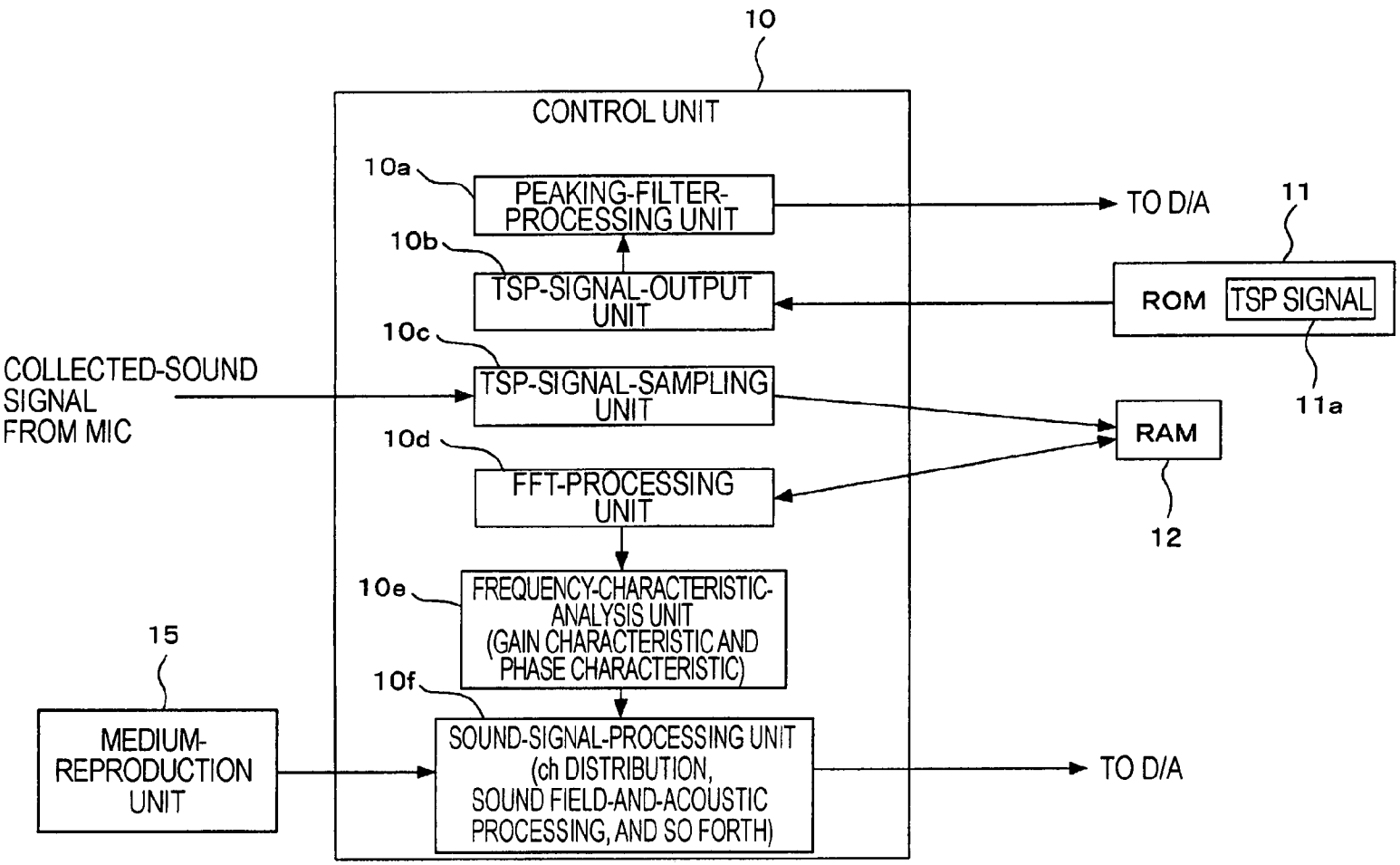
FIG. 2 illustrates various functional operations performed by a control unit provided in the sound-signal-processing device.

FIG. 2 is a block diagram illustrating the various functional operations performed by the control unit 10. Further, FIG. 2 also shows the medium-reproduction unit 15, the ROM 11, and the RAM 12 that are described in FIG. 1.

As shown in FIG. 2, the control unit 10 performs the functional operations shown as a peaking filter 10*a*, a TSP-signal-output unit 10*b*, a TSP-signal-sampling unit 10*c*, an FFT-processing unit 10*d*, a frequency-characteristic-analysis unit 10*e*, and a sound-signal-processing unit 10*f*.

In the first embodiment, the control unit 10 achieves the above-described various functional operations by performing software processing, for example. However, the functional operations shown in blocks may be achieved by using hardware.

First, the peaking filter 10*a* is provided, so as to boost a desired frequency band of the TSP signal 11*a* output from the speaker SP via the sound-output terminal Tout. Information about the value Q, center frequency, and a gain of the peaking filter can be set to the peaking filter 10*a*. Subsequently, the peaking filter 10*a* boosts the desired frequency band of the TSP signal 11*a* on the basis of the above-described set values.

The TSP-signal-output unit 10*b* outputs TSP signals that should be output from the speaker SP during the frequency-characteristic analysis that will be described later on the basis of the TSP signal 11*a*, where data on the TSP signal 11*a* is stored in the ROM 11. Namely, TSP-signal-output unit 10*b* outputs information about the values of the TSP signal 11*a* in sequence on the basis of the operation-clock frequency. Each of the values of the TSP signals that are output in the above-described manner is transmitted to the speaker SP via the D/A converter 14 and the sound-output terminal Tout that are shown in FIG. 1 in that order. Subsequently, a sound signal generated on the basis of the TSP signal 11*a* is output from the speaker SP, as an actual sound.

In the first embodiment, when information about the frequency characteristic is acquired, the TSP signal is output from each of the entire speakers SP1 to SP4. Subsequently, the TSP-signal-output unit 10*b* is made to output the TSP signal to each of lines of the entire speaker channels. That is to say, the TSP signal is output to each of a line connected to the sound-output terminal Tout1, a line connected to the sound-output terminal Tout2, a line connected to the sound-output terminal Tout3, and a line connected to the sound-output terminal Tout4, as shown in FIG. 1.

The frequency-characteristic information can be acquired on the basis of the TSP signal output only from a selected speaker SP. In that case, the TSP-signal-output unit 10*b* outputs the TSP signal to the line connected to the sound-output terminal Tout corresponding to the selected speaker SP.

The TSP-signal-sampling unit 10*c* transmits a signal that is transmitted from the A/D converter 13 shown in FIG. 1 and that is collected by the microphone M1, as a collected sound signal relating to the TSP signal output from the speaker SP. Then, the TSP-signal-sampling unit 10*c* samples the collected sound signal on the basis of the operation-clock frequency. Data on the sampled signal and/or the TSP signal, the data being referred to as TSP data, is stored in the RAM 12.

The FFT-processing unit 10*d* performs FFT processing for the sampled TSP signal. Namely, information about the frequency characteristic of a sound signal that is output from the speaker SP and that is transmitted to the microphone M1 is acquired. Information about the TSP signal that had been subjected to the FFT processing is also stored in the RAM 12.

For acquiring the frequency-characteristic information, the sampled TSP signal may be subjected to Fourier-transform processing different from the above-described FFT processing.

The frequency-characteristic-analysis unit 10*e* analyzes the frequency characteristic acquired through the FFT processing. More specifically, the frequency characteristic is analyzed by calculating the gain characteristic and/or the phase characteristic.

The sound-signal-processing unit 10*f* performs channel (ch)-distribution processing, sound field-and-acoustic processing, and so forth, as shown in FIG. 2.

The ch-distribution processing is performed, as below. The sound-signal-processing unit 10*f* distributes audio signals of a plurality of systems, the audio signals being generated on the basis of signals transmitted from the medium-reproduction unit 15, to the lines connected to the speakers SP corresponding to the systems (namely, the sound-output terminals Tout corresponding to the systems) so that the audio signals are output. For example, when the audio system 1 is provided, as a car-audio system, audio signals of two systems Lch and Rch, the audio signals being reproduced by the medium-reproduction unit 15, are distributed to lines connected to the speakers SP corresponding to the systems Lch and Rch (the sound-output terminals Tout corresponding to the systems Lch and Rch) so that the audio signals are output.

When the audio system 1 is provided, as a 5.1-ch surround system, and audio signals of the two systems Lch and Rch are reproduced by the medium-reproduction unit 15, audio signals of the six systems corresponding to 5.1 channels, are generated from the audio signals of the two systems. Then, the audio signals of the six systems are distributed to lines connected to the sound-output terminals Tout corresponding to the six systems so that the audio signals are output.

Further, the above-described sound field-and-acoustic processing indicates processing performed, so as to achieve various acoustic effects by performing equalizing processing or the like and/or processing performed, so as to achieve a sound-field effect such as digital reverb.

Further, in the first embodiment, the sound-signal-processing unit 10*f* performs various types of adjustment. For example, the sound-signal-processing unit 10*f* performs gain adjustments for every frequency band for the audio signal reproduced by the medium-reproduction unit 15 on the basis of a result of the frequency-characteristic analysis performed by the frequency-characteristic-analysis unit 10*e*.

Various technologies to adjust audio signals that should be output from the speaker SP on the basis of the result of the frequency-characteristic analysis have already been proposed. Therefore, details on the adjustment will not be limited in this specification.

Thus, the TSP signal is used in the first embodiment, as in the past, so as to acquire the frequency-characteristic information.

However, in the case where the known method using the TSP signal is performed, as described above, the value of each of the frequency intervals of the TSP signal is determined to be Fs/n, where the frequency interval can be considered to be a resolution of frequencies of an analyzable frequency band. Subsequently, in the case where a low frequency band of from a few tens of Hz to a few hundred Hz is divided into small bands and each of the small bands is analyzed, the number of samples of the TSP signal, which is designated by n, should be increased.

Thus, when the frequency characteristic of a low-frequency band is analyzed at short intervals according to the known method, the capacity of a memory (the ROM 11) storing data on the TSP signal should be increased. Further, the value of the sample number n is increased so that the number of samples subjected to the FFT processing is increased. Subsequently, the processing load placed on the control unit 10 increases.

Namely, when the hardware resource is poor, which means that the capacity of memories of the reproduction device 2 is small and/or the processing capacity of the control unit 10 is small, for example, it is difficult to increase the value of the sample number n, so that the value of the frequency interval of the TSP signal increases. Thus, it becomes difficult to acquire information about the frequency characteristic of a low-frequency band at short intervals.

Thus, according to the known method, the intervals at which the frequency-characteristic information is acquired are limited depending on the hardware resource of the reproduction device 2.

Figure 3:
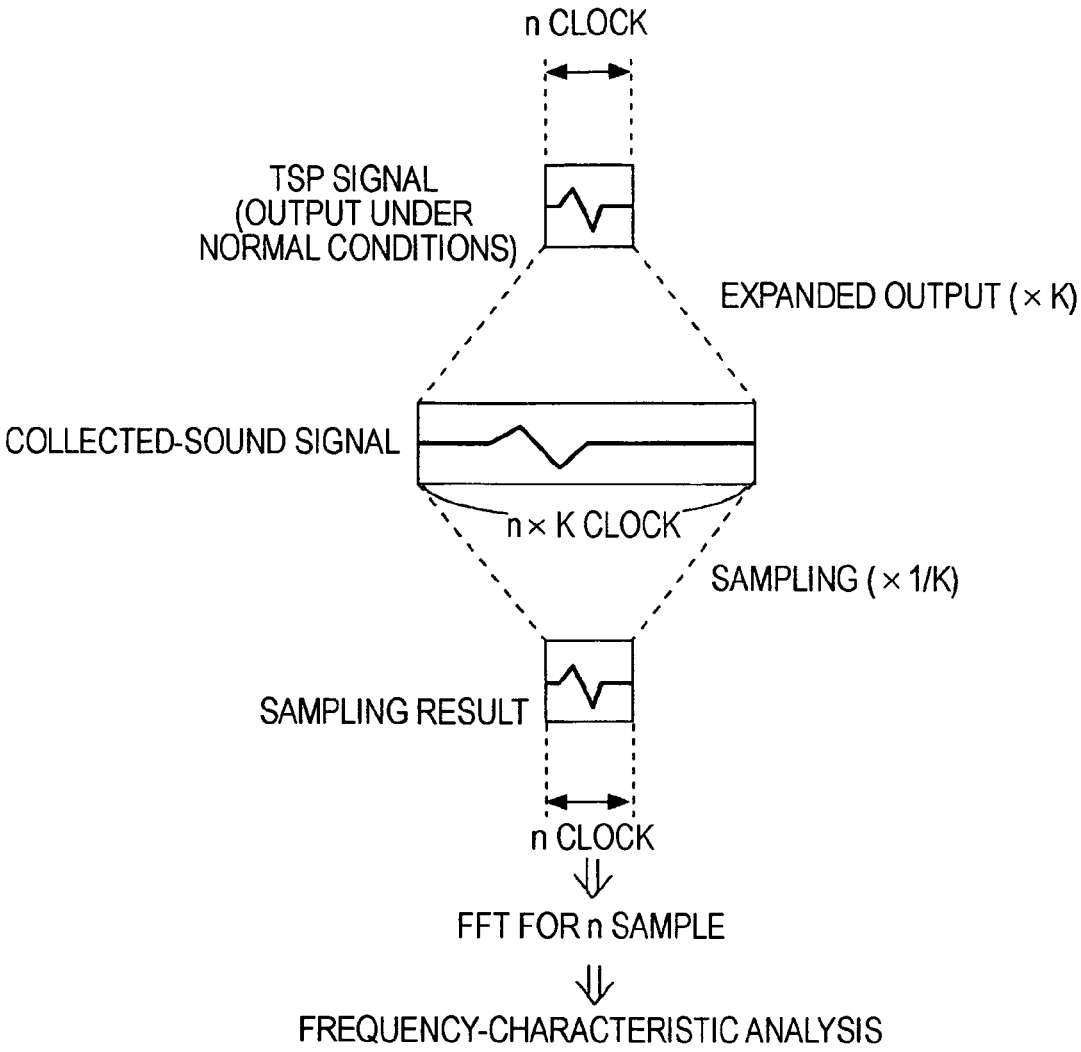
FIG. 3 illustrates frequency-characteristic-analysis operations performed according to the above-described embodiment.

In the first embodiment, therefore, the TSP signal is expanded in the time-axis direction and output according to a method described in FIG. 3.

First, the waveform of the TSP signal, the TSP-signal waveform being shown in FIG. 3, is obtained when each of values of the TSP signal 11*a* is output every single clock, where data on the TSP signal 11*a* is stored in the ROM 11 shown in FIGS. 1 and 2. Namely, the above-described TSP-signal waveform is obtained when the TSP signal is output under normal conditions.

In the first embodiment, the TSP signal is expanded by a predetermined number of times in the time-axis direction and output. In the first embodiment, the TSP-signal value is expanded by K times in the time-axis direction and output. In the following description, the rate at which the TSP signal is expanded in the time-axis direction is designated by K.

Each of frames surrounding waveforms shown in FIG. 3 denotes the beginning and ending of a single period of the TSP signal.

Figure 4A:
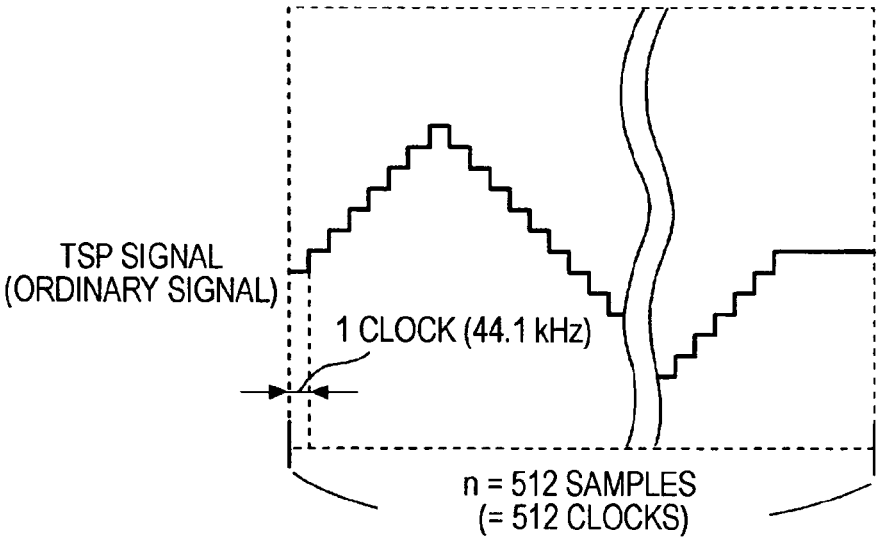
FIG. 4A shows the case where a TSP signal is output under normal conditions so that the case can be compared with the case where the TSP signal is expanded and output, as shown in FIG. 4B.

FIG. 4A illustrates the TSP signal output under the normal conditions for verification. Namely, when the number of samples of the TSP signal 11*a* is determined to be n, each of values of from zero to n samples is output every single clock.

As described above, the number n of samples of the TSP signal of the first embodiment is determined to be 512. In that case, therefore, a single period length of the TSP signal is determined to be 512 clocks.

Further, in that case, the operation-clock frequency is 44.1 kHz. Therefore, a single period length of the TSP signal output under the normal conditions is shown by the expression 512/44100 sec.

Figure 4B:
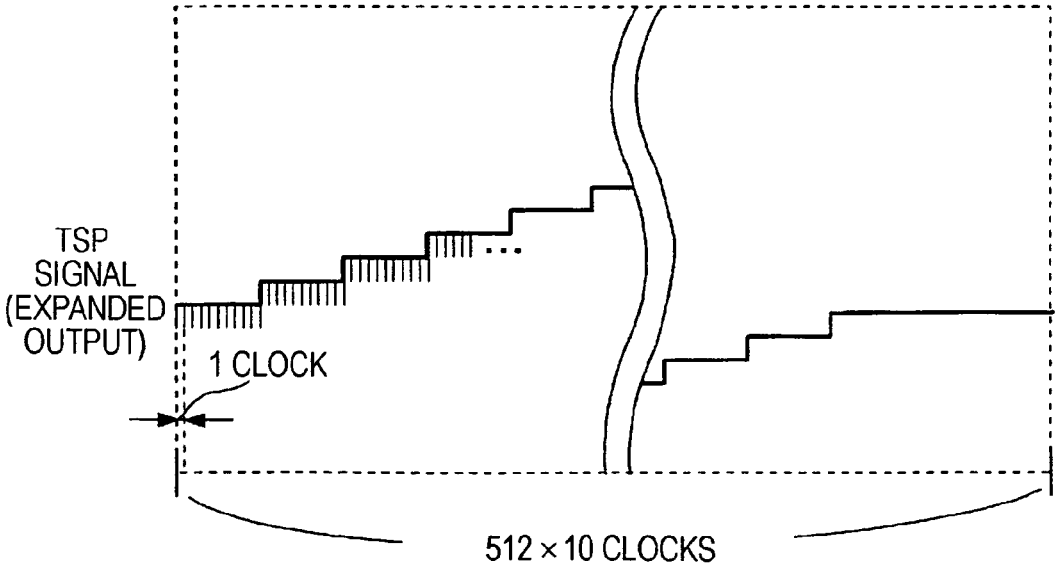
FIG. 4B shows the case where the TSP signal is expanded and output so that the case can be compared with the case where the TSP signal is output under normal conditions, as shown in FIG. 4A.

In the first embodiment, as a method of expanding the TSP signal in the time-axis direction, the TSP signal 11*a* is up-sampled and output, as shown in FIG. 4B. Namely, each of values of the TSP signal is output for a predetermined plurality of clocks.

In that case, the value of the rate K at which the TSP signal is expanded in the time-axis direction is determined to be ten.

Therefore, each of the values of the TSP signal is output for ten clocks, so that the value of a single period length of the TSP signal to be output is shown by the expression 512×10 clocks. Further, at the sampling rate of 44.1 kHz, the single period length of the TSP signal is shown by the expression 5120/44100 sec.

Returning to FIG. 3, when the TSP signal is expanded in the time-axis direction and output in the above-described manner, a collected-sound signal shown in FIG. 3 is obtained by the microphone M1. The collected-sound signal is an expanded signal with a single period length of which value is obtained by multiplying n clocks by K.

Further, in the first embodiment, the collected-sound signal or the expanded signal is down-sampled by as much as the value corresponding to the rate K at which the TSP signal is expanded. More specifically, since the TSP signal is expanded by ten times, the collected-sound signal is down-sampled to a tenth of the original collected-sound signal. Namely, the expanded signal or the collected-sound signal is sampled once every ten clocks. Therefore, a single period length of a signal acquired in the above-described manner becomes the same as that of the TSP signal which is not yet expanded and output. In that case, the single period length of the acquired signal is shown by the equation n=512 clocks.

Further, the TSP signal acquired by performing the above-described down-sampling is subjected to the FFT processing performed by using n samples. Namely, the FFT processing is performed for the n samples of the TSP signal so that the frequency-characteristic information is acquired.

After that, the frequency-characteristic information acquired by performing the FFT processing is analyzed. More specifically, the frequency characteristic is analyzed by calculating the gain characteristic and/or the phase characteristic.

Here, the TSP signal is expanded in the time-axis direction by K times and output. In that case, the TSP signal includes signals generated in the frequency band of from 0 Hz to Fs/2×K Hz, where gains of the signals generated at each of intervals of Fs/n×K Hz are the same as one another. That is to say, the TSP signal includes signals generated in the frequency range of from 0 to Fs/2×K Hz, where the gains of the signals corresponding to each of intervals of Fs/n×K Hz are the same as one another.

Subsequently, the range of the frequencies included in the TSP signal is reduced by as much as the value corresponding to the rate at which the TSP signal is expanded (the reduction rate is shown by the expression 1/K). However, the frequency interval can be reduced by as much as the value corresponding to the rate at which the TSP signal is expanded (the reduction rate is shown by the expression 1/K).

Further, according to the above-described operations, the TSP signal expanded by K times in the time-axis direction is down-sampled to a K-th of the original TSP signal according to the expansion rate K and acquired. The acquired TSP signal becomes the same as that acquired by using the original n samples that are not yet output.

When the TSP signal acquired by using the n samples is subjected to the above-described FFT processing using the n samples, a frequency resolution (the frequency interval) achieved by the above-described FFT processing becomes an interval of (Fs/K)/n Hz. More specifically, the value of each of the frequency intervals is 8.61 Hz on the basis of the equations Fs=44.1 kHz, K=10, and n=51.

In that case, however, the TSP signal is expanded in the time-axis direction. Therefore, the frequency range is reduced according to the rate K, as described above. Namely, since the TSP signal includes the signals generated in the frequency range of from 0 Hz to Fs/2 Hz, the frequency range of the signals included in the TSP signal expanded by K times in the time-axis direction is reduced to the frequency range of from 0 Hz to (Fs/K)/2 Hz.

Subsequently, according to the method used in the first embodiment, the range of an analysis is reduced by as much as the value corresponding to the rate at which the TSP signal is expanded. However, each of the frequency intervals can be decreased by as much as the value corresponding to the expansion rate. Namely, according to the above-described method, the frequency-characteristic information can be acquired at short intervals determined according to the expansion rate irrespective of the number n of samples of the TSP signal so that the frequency characteristic can be analyzed at short intervals without being affected by the hardware resource of the reproduction device 2 and/or the control unit 10.

The above-described effect can be clearly understood by comparing the known method with the method used in the first embodiment. Namely, according to the known method, the value of the sample number n is determined to be 4096 so that the value of each of the frequency intervals is set to about 10.8 Hz. Further, according to the method used in the first embodiment, the value of the sample number n is determined to be 512 and the value of the expansion rate K is determined to be 10 so that the value of each of the frequency intervals is set to about 8.61 Hz.

Further, in the first embodiment, the range of frequencies included in the TSP signal is reduced to a K-th of the original frequency range. Therefore, according to the method used in the first embodiment, it becomes possible to analyze the low-frequency band at short intervals.

Further, as has been described, the TSP signal expanded by K times is down-sampled to a K-th of the original TSP signal and acquired so that the number of samples subjected to the FFT processing, the samples being included in the acquired TSP signal, can be determined to be the number n of the samples of the TSP signal. Namely, even though the interval value of about 10.8 Hz that can be set by performing the known method is approximately the same as the interval value of about 8.61 Hz that can be set by performing the method used in the first embodiment, the FFT processing is performed for the samples of which number is shown by the equation n=4096 according to the known method. On the other hand, according to the method used in the first embodiment, the FFT processing is performed for the samples of which number is shown by the equation n=512. Thus, according to the first embodiment, it becomes possible to decrease the number of samples subjected to the FFT processing necessary to acquire the frequency-characteristic information.

Thus, since the number of samples subjected to the FFT processing can be reduced, the processing capability of the control unit 10 can be reduced. Further, since the sample number n can be reduced according to the expansion rate K to be set, the number of samples subjected to the FFT processing can be reduced according to the reduced sample number n. That is to say, the FFT-processing capability of the control unit 10 can be reduced by as much as the value corresponding to the expansion rate K to be set, which also allows for analyzing the frequency characteristic at the short intervals without being affected by the hardware resource of the reproduction device 2.

Next, processing operations performed, so as to achieve the frequency-characteristic-analysis operations according to the first embodiment will be described with reference to flowcharts shown in FIGS. 5 and 6.

Figure 5:
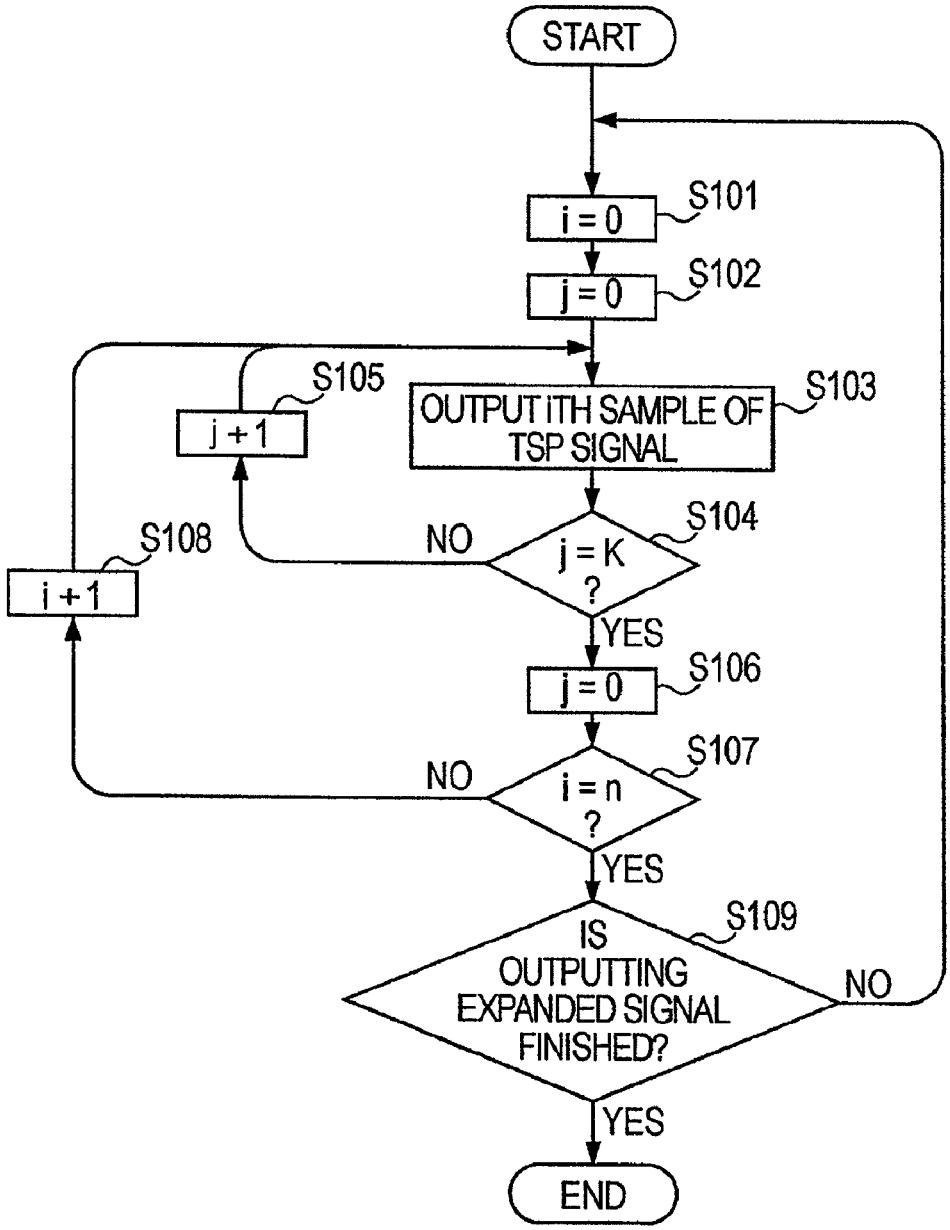
FIG. 5 is a flowchart showing processing operations performed when the TSP signal (time-expanded signal) is output, as the frequency-characteristic-analysis operations performed according to the above-described embodiment.
Figure 6:
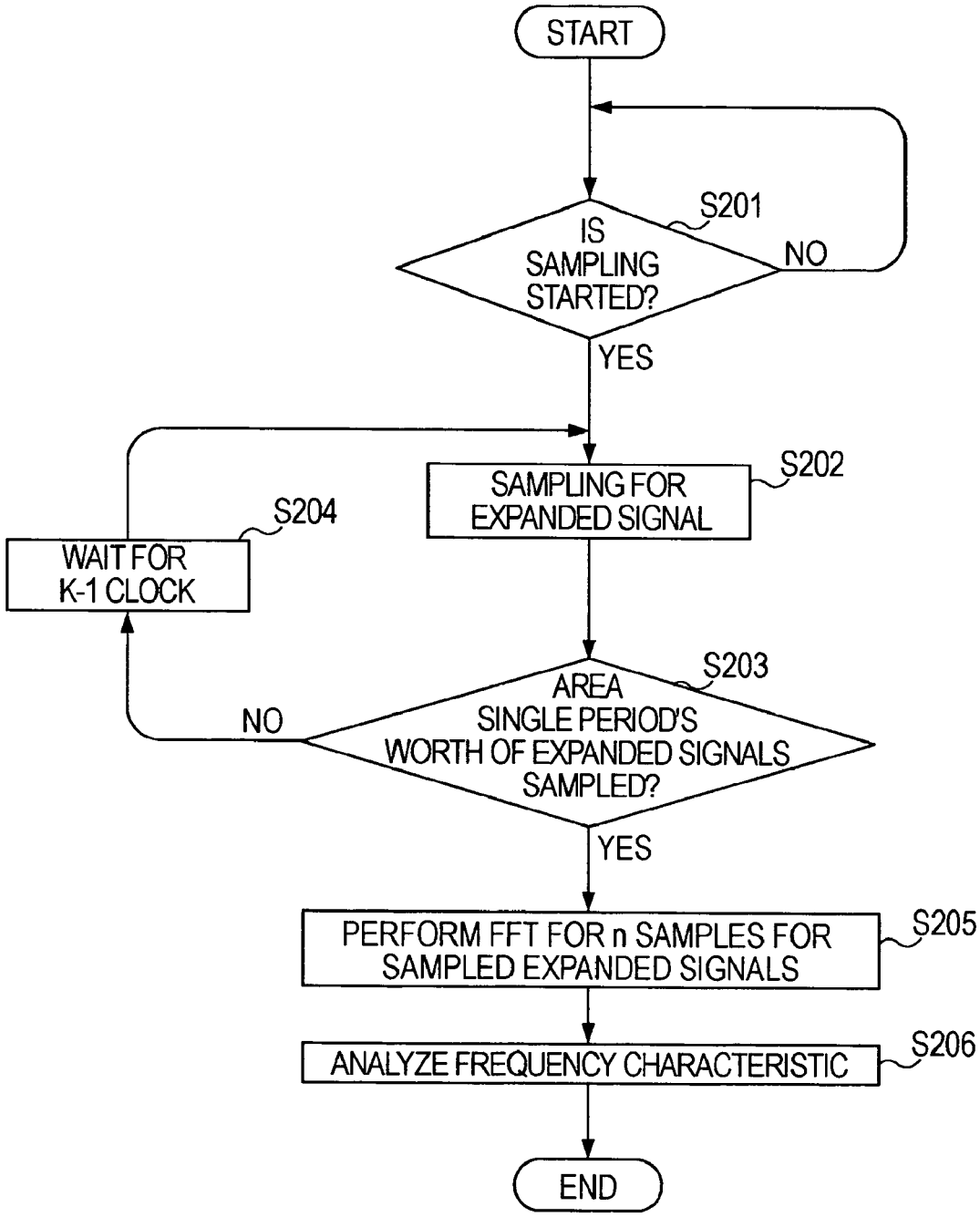
FIG. 6 is a flowchart showing processing operations performed over a time period from when a collected-sound signal is sampled to when a frequency characteristic is analyzed, as the frequency-characteristic-analysis operations performed according to the above-described embodiment.

The processing operations shown in FIGS. 5 and 6 are performed by the control unit 10 shown in FIGS. 1 and 2 according to a program stored in the ROM 11, for example.

FIG. 5 shows processing operations performed when the TSP signal (time-expanded signal) is output, as the frequency-characteristic-analysis operations of the first embodiment. The processing operations shown in FIG. 5 correspond to operations performed by the TSP-signal-output unit 10*b* provided, as one of the functional blocks shown in FIG. 2.

In FIG. 5, at step S101, an output-value-identification count value i is reset to zero. The output-value-identification count value i is used, so as to determine which of the samples of the TSP signal 11*a* on which data is stored in the ROM 11 should be output, at step S103 which will be described later.

At step S102, an output-number-identification count value j is reset to zero. The output-number-identification count value j is used, so as to determine how many times a single value of values of the TSP signal is output, at step S103.

At step S103, the i-th sample of the TSP signal is output. That is to say, a value specified by the above-described output-value-identification count value i, the specified value being included in the values of the TSP signal 11*a* on which data is stored in the ROM 11, is output to the D/A converter 14 shown in FIG. 1.

Then, at step S104, it is determined whether or not the output-number count value j attains the value of the expansion rate K. In that case, the value of the expansion rate K is set to 10, for example, as described above.

When the output-number count value j does not attain the value of the expansion rate K so that a negative result is obtained, at step S104, the processing advances to step S105 where the output-number-identification count value j is incremented by one, as shown by the expression j+1. Then, the processing returns to step S103 where the i-th sample of the TSP signal is output again. Thus, since the processing procedures corresponding to steps S104, S105, S103, and S104 are performed in repetition in that order, each of the values of the TSP signal are output for the plurality of clocks of which number is determined according to the expansion rate K.

When the output-number-identification count value j attains the value of the expansion rate K so that a positive result is obtained, at step S104, the processing advances to step S106 where the output-number-identification count value j is reset to zero, and it is determined whether or not the output-value-identification count value i attains the value of the sample number n, at step S107.

The sample-number value n denotes the number of n samples of the TSP signal 11*a*. Namely, at step S107, it is determined whether or not a single period's worth of TSP signals are output. In other words, it is determined whether or not the entire values of the TSP signal are output.

At step S107, when the output-value-identification count value i does not attain the sample-number value n so that a negative result is obtained, at step S107, the processing advances to step S108 where the output-value-identification count value i is incremented by one, as shown by the expression i+1. Then, the processing returns to step S103 where the i-th sample of the TSP signal is output again.

Further, at step S107, when the output-value-identification count value i attains the sample-number value n so that a positive result is obtained, the processing advances to step S109 where it is determined whether or not outputting the expanded signal should be finished. That is to say, it is determined whether or not the expanded signal is output over a predetermined time period.

When it is determined that the expanded signal is not output over the predetermined time period so that a negative result is obtained, at step S109, the processing returns to step S101 so that the expanded signal is output, as shown in FIG. 5.

When it is determined that the expanded signal is output over the predetermined time period so that a positive result is obtained, at step S109, the output processing shown in FIG. 5 is finished.

FIG. 6 shows processing operations performed over a time period from when the collected-sound signal is sampled to when the frequency characteristic is analyzed, as the frequency-characteristic-analysis operations performed in the first embodiment.

It should be noted that the processing operations shown in FIG. 6 are performed in parallel with the processing operations shown in FIG. 5. Further, the processing operations shown in FIG. 6 correspond to operations performed by the TSP-signal-sampling unit 10*c*, the FFT-processing unit 10*d*, and the frequency-characteristic-analysis unit 10*e* that are provided, as the functional blocks shown in FIG. 2.

In FIG. 6, at step S201, the control unit 10 waits until it enters the state where the sampling should be started. Namely, the control unit 10 waits until it enters the state where sampling of the expanded signal output from the speaker SP should be started due to the processing operations shown in FIG. 5. More specifically, the control unit 10 waits until predetermined time elapses after outputting of the expanded signal is started.

Then, at the time where the sampling of the expanded signal should be started, the expanded signal is sampled, at step S202. That is to say, a sound signal that is collected by the microphone M1 and that is transmitted via the A/D converter 13 is sampled.

At step S203, it is determined whether or not a single period's worth of the expanded signals are sampled. Namely, it is determined whether or not a single period's worth of the expanded signals are sampled, as the collected-sound signal transmitted from the A/D converter 13.

Further, in that case, the TSP signal is expanded in the time-axis direction by K times (ten times), as the expanded signal, as shown in FIG. 3. That is to say, it is determined whether or not sampling is performed for the 512×K-th clock (the 512×10-th clock) after the sampling is started.

If it is determined that the single period's worth of the expanded signals are not sampled so that a negative result is obtained, at step S203, the processing advances to step S204 where the control unit 10 waits over the time period corresponding to K−1 clocks. Then, the processing returns to step S202 where the expanded signal (the collected-sound signal) is sampled again.

Since the wait processing corresponding to step S204 is performed, the down-sampling shown in FIG. 3 is achieved.

When the singe period's worth of the expanded signals are sampled so that a positive result is obtained, at step S203, the FFT processing is performed for the n samples for the sampled expanded signals. That is to say, since the number of samples of the expanded signals acquired by performing the down-sampling becomes n again, the FFT processing is performed for the n samples.

After that, the frequency characteristic is analyzed, at step S206. Namely, the gain characteristic and/or phase characteristic is calculated for the frequency characteristic acquired through the above-described FFT processing, so as to analyze the frequency characteristic.

Information about the frequency characteristic analyzed in the above-described manner is used for audio-signal adjustment performed by the control unit 10, as the sound-signal-processing unit 10*f*.

Figure 7:
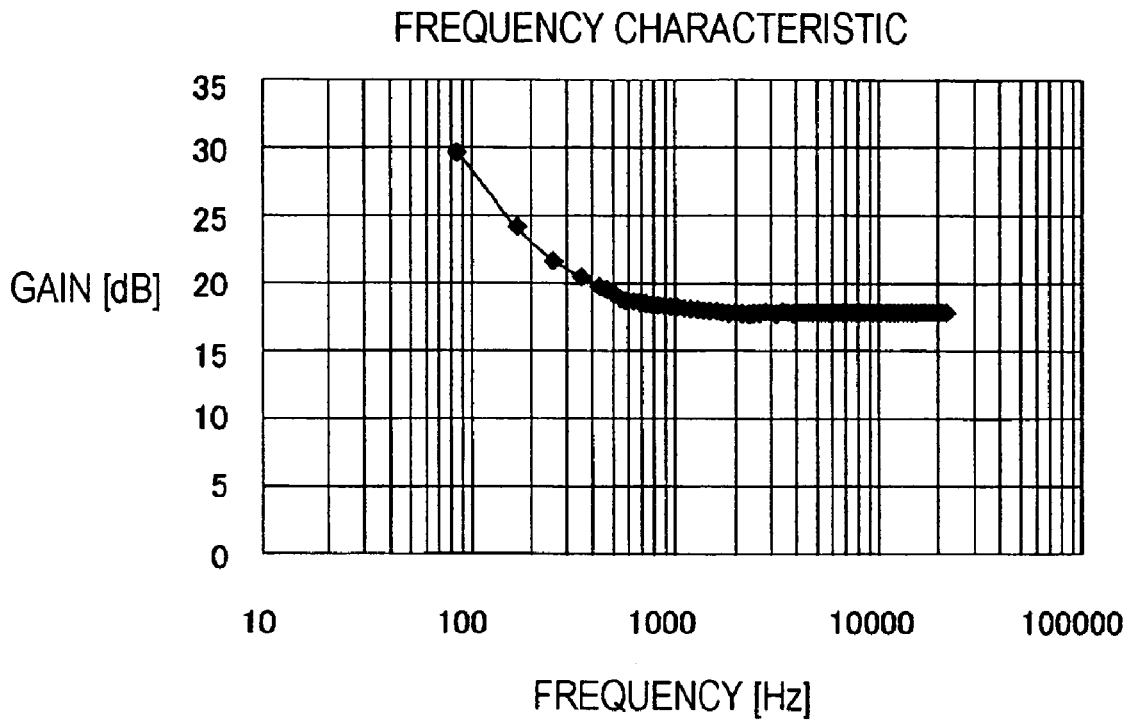
FIG. 7 shows a frequency characteristic acquired according to a known method, as an experiment result.
Figure 8:
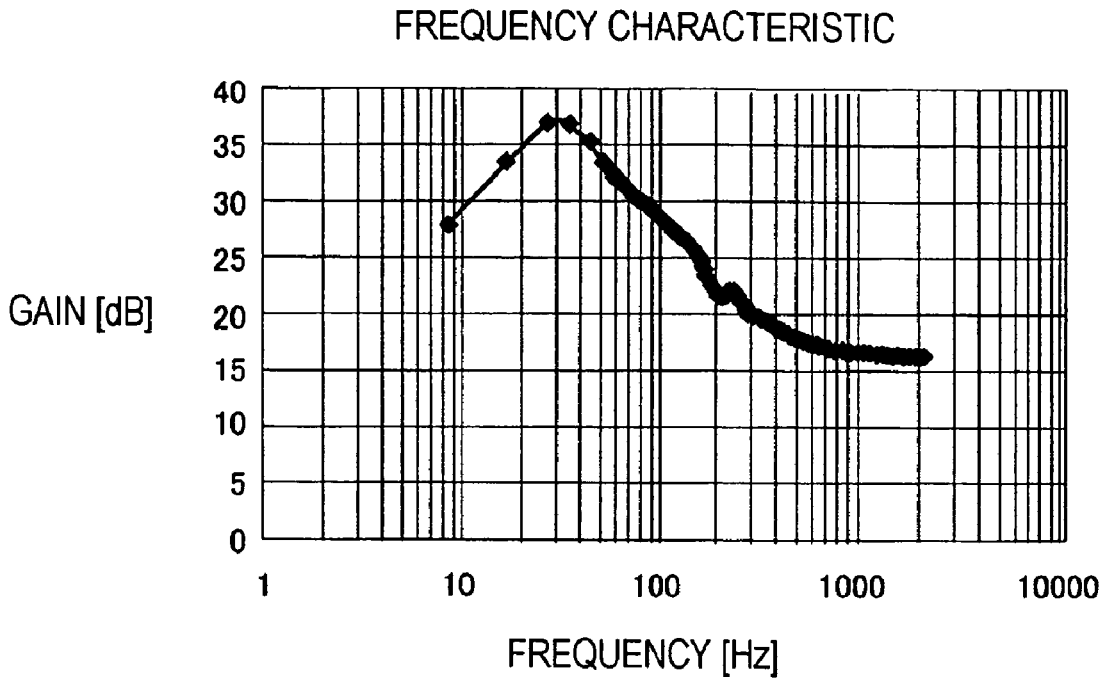
FIG. 8 shows a frequency characteristic acquired according to a method according to the above-described embodiment, as another experiment result.

Each of FIGS. 7 and 8 shows the result of an experiment performed, so as to acquire the frequency-characteristic information by actually outputting the TSP signal.

FIG. 7 shows a result obtained when a sound signal collected by the microphone M1 is sampled and subjected to the FFT processing according to the known method. FIG. 8 shows a result obtained when the sound signal collected by the microphone M1 is sampled and subjected to the FFT processing according to the method used in the first embodiment. Namely, each of FIGS. 7 and 8 shows a result of the frequency-characteristic acquisition. In each of FIGS. 7 and 8, gains (dB) are shown along the vertical axis and frequencies (Hz) are shown along the horizontal axis.

For attaining the experiment results shown in FIGS. 7 and 8, the number n of the samples of the TSP signal is determined to be 512 and the value of the sampling rate Fs is determined to be 44.1 kHz. Further, according to the first embodiment shown in FIG. 8, the value of the expansion rate K is determined to be 10.

Each of FIGS. 7 and 8 shows a result obtained where the TSP signal output from the speaker SP is subjected to peaking filtering where the equation Q=1 holds, the value of the gain is determined to be 20 dB, and the value of the center frequency is determined to be 30 Hz.

First, when the known method shown in FIG. 7 is used and the sample number n is determined to be 512, the value of an analyzable frequency interval can be calculated, roughly shown by the equation 44100/512=86.1 Hz where the expression Fs/n holds. Therefore, it is difficult to analyze frequencies around the center frequency of 30 Hz set to the peaking filter 10*a*. In that case, since the value of the analyzable-frequency interval is about 86.1 Hz, frequencies closest to the center frequency of 30 Hz are those of about 86.1 Hz. The closest frequencies of about 86.1 Hz are boosted by as much as about 12 dB with reference to high frequencies of which values generate an approximately straight line, as shown in FIG. 7.

On the other hand, according to the first embodiment shown in FIG. 8, the range of frequencies of the signals included in the TSP signal is reduced to the range of from 0 to (Fs/K)/2 Hz, more specifically, the range of from 0 to 4410/2 Hz, that is, the range of from 0 to 2.205 kHz, since the value of the expansion rate K is 10. In FIG. 8, therefore, the approximately straight line generated by the high frequencies, the straight line being shown in FIG. 7, is not observed. However, since the value of the analyzable frequency interval is about 8.61 Hz, the characteristics of frequencies around the center frequency of 30 Hz, the center frequency being set by the peaking filter 10*a*, can be analyzed. As shown in FIG. 8, the values of gains obtained around the center frequency of 30 Hz are boosted by as much as about 20 dB with reference to those obtained around the high-frequency area.

The results of the above-described experiments show that the method used in the first embodiment allows for analyzing the frequency characteristic appropriately.

It should be noted that the present invention can be achieved without being limited to the above-described embodiment.

For example, in the first embodiment, the same signal values are output for a plurality of predetermined clocks, as outputs of the expanded signal. However, signal values may be output for each of pluralities of predetermined clocks (e.g., every ten clocks, as is the case with the first embodiment) and linear interpolation and/or zero interpolation may be performed over other periods.

In any case, when the collected-sound signal is down-sampled, as is the case with the first embodiment, the TSP signal is expanded in the time-axis direction and down-sampled according to the rate at which the TSP signal is expanded.

Figure 9:
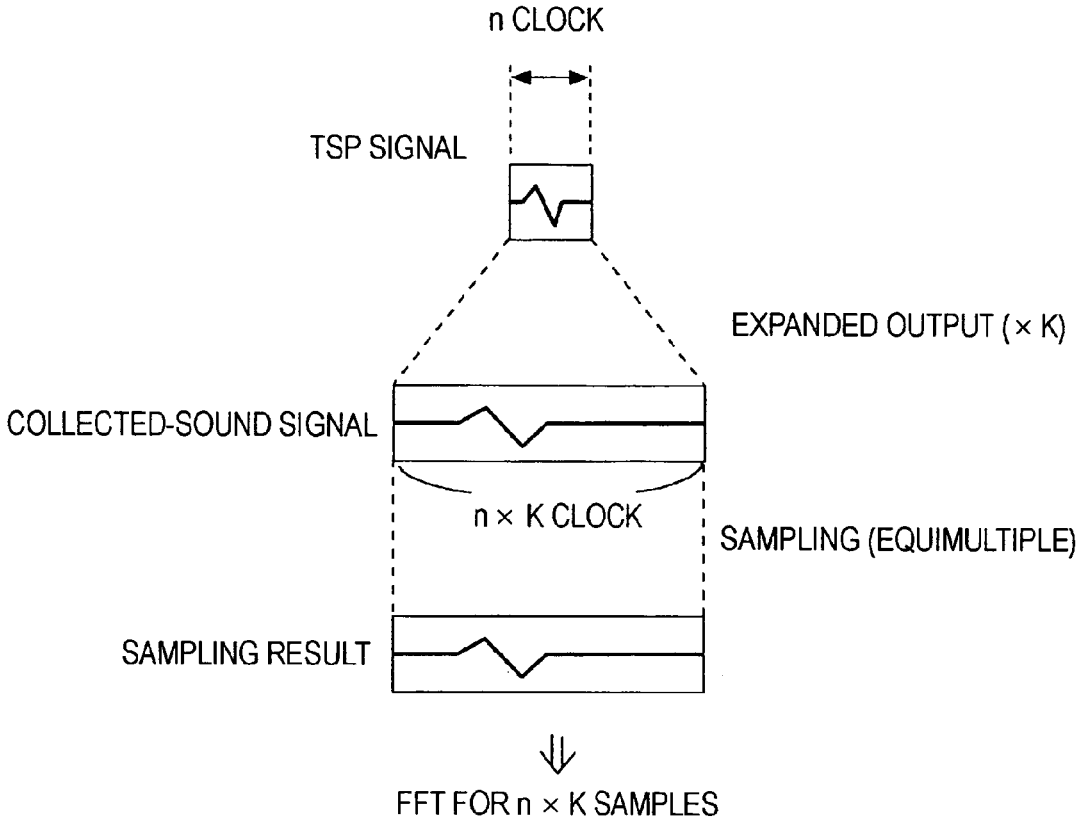
FIG. 9 shows an example modification of the first embodiment.

Further, according to the first embodiment, the TSP signal that is expanded by K times and that is output is reduced to a K-th of the original TSP signal and acquired, so as to decrease the number of samples subjected to the FFT (Fourier transform) processing. However, when the number of samples subjected to the Fourier-transform processing is not particularly important, the TSP signal that is expanded by K times and that is output may be sampled, as it is, instead of being subjected to down-sampling, and subjected to the Fourier-transform processing, so that the frequency-characteristic information is acquired, as shown in FIG. 9. That is to say, the collected-sound signal of the TSP signal that is expanded by K times and output is sampled for every single clock and acquired, and subjected to the Fourier-transform processing, so that the frequency-characteristic information is obtained.

According to the above-described configuration, the TSP signal is also expanded and output. Therefore, the range of analyzable frequencies is limited to a frequency range determined on the basis of the expansion rate K, as is the case with the first embodiment. However, the frequency interval can be decreased by as much as the value corresponding to the expansion rate K. Subsequently, the number n of samples that should be held, as the TSP signal, can be decreased according to the expansion rate K, and the frequency interval is not limited due to the memory capacity considered to be the hardware resource of the reproduction device 2.

However, since the expanded TSP signal is sampled, as it is, the number of samples subjected to the Fourier-transform processing is determined according to the expression n×K, as shown in FIG. 9. Further, with regard to the processing capability of the reproduction device 2, the frequency interval is limited.

Therefore, the above-described method is effective when the memory capacity is poor even though the reproduction device 2 has a sufficient processing capability.

Further, according to the first embodiment, the TSP signal is expanded and output through the up-sampling, as shown in FIG. 4B. In that case, however, a high-frequency noise may occur in the expanded TSP signal. It is expected that the higher the expansion rate, the more significant the occurrence of the high-frequency noise becomes.

Figure 10:
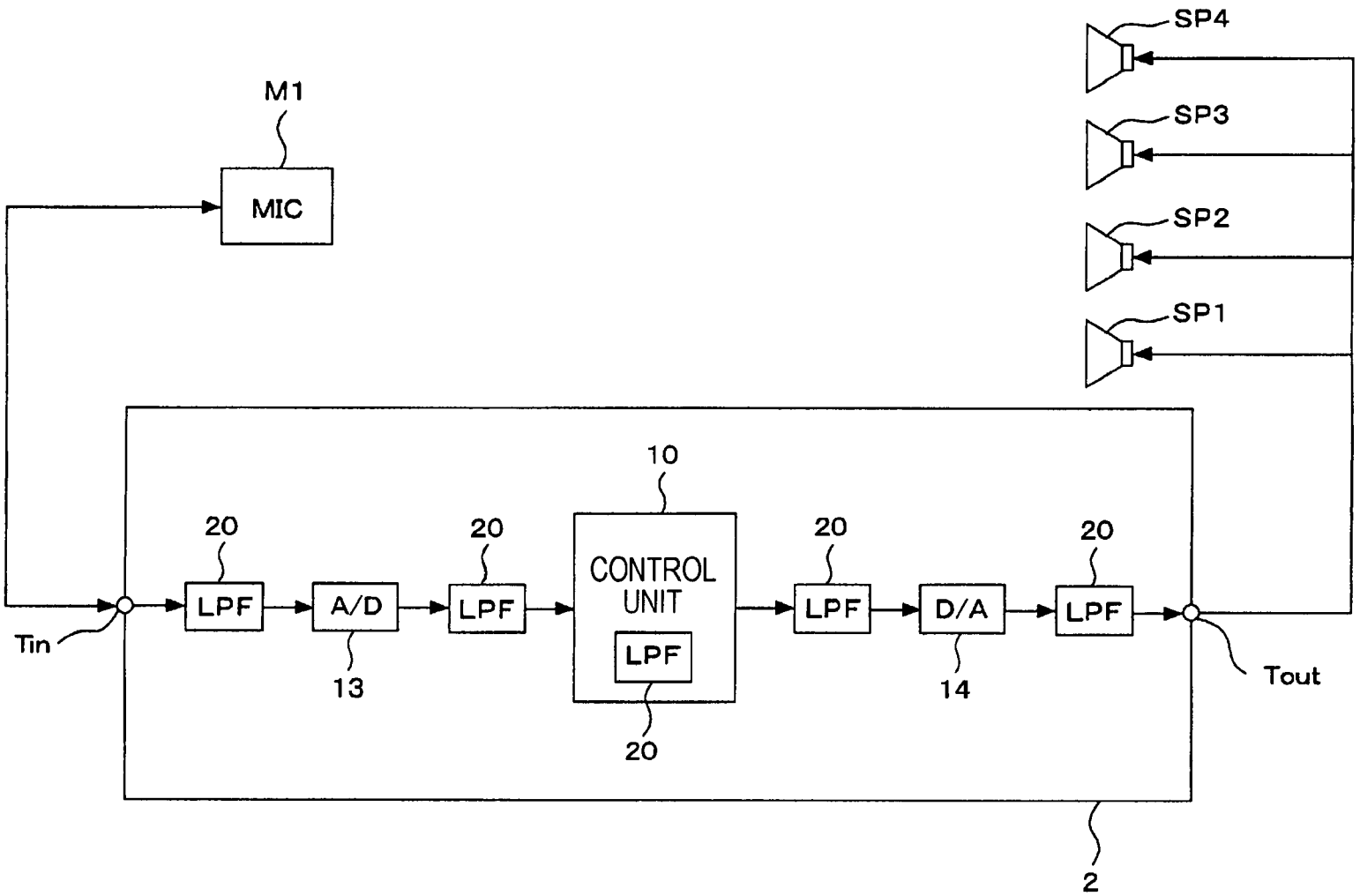
FIG. 10 is a block diagram showing an example modification of the sound-signal-processing device according to the above-described embodiment.

Therefore, in the reproduction device 2, at least one low-pass filter (LPF) 20 may be provided in a system used for outputting the TSP signal and/or a system used for collecting and sampling the TSP signal, as shown in FIG. 10. More specifically, the LPF 20 may be provided between the sound-input terminal Tin and the A/D converter 13, and/or the A/D converter 13 and the control unit 10. Further, the LPF 20 may be provided in the control unit 10, between the control unit 10 and the D/A converter 14, and/or the D/A converter 14 and the sound-output terminal Tout, for example.

The above-described configuration allows for effectively reducing the high-frequency noise occurring in the expanded TSP signal and acquiring information about a correct frequency characteristic.

Further, according to the above-described embodiments, the single period's worth of expanded signals are sampled and the frequency-characteristic information is obtained. However, a plurality of period's worth of expanded signals may be acquired, and added and averaged. After that, the averaged signals are subjected to the Fourier-transform processing, so that the frequency-characteristic information is obtained.

In FIG. 1, the medium-reproduction unit 15 is provided, so as to reproduce an audio signal recorded onto a recording medium. However, the medium-reproduction unit 15 may be provided, as a discrete amplitude modulation (AM)-and-frequency modulation (FM) tuner configured to receive and demodulate AM and/or FM, for example, and output the audio signal.

The reproduction device 2 is configured to reproduce (receive and/or demodulate) the audio signal, for example. However, the reproduction device 2 may be configured to reproduce a video signal, so as to be used for a recording medium onto which the audio signal and the video signal are recorded, and a television broadcast. In that case, it is essential only that the reproduction device 2 is configured, so as to output the video signal transmitted in synchronization with the audio signal.

Thus, a sound-signal-processing device according to an embodiment of the present invention includes the above-described medium-reproduction unit 15, so as to have the function of reproducing data recorded onto a recording medium and/or the function of receiving a broadcast signal. However, the sound-signal-processing device may further include an amplifier, so as to input a sound signal reproduced (received) outside and adjust the input sound signal on the basis of an analyzed frequency characteristic.

It should be understood by those skilled in the art that various modifications, combinations, sub-combinations and alterations may occur depending on design requirements and other factors insofar as they are within the scope of the appended claims or the equivalents thereof.

What is claimed is:

1. A frequency-characteristic-acquisition device that inputs a time-stretched-pulse signal to a system to be measured and that acquires information about a frequency characteristic of the system based on a signal output from the system, the frequency-characteristic-acquisition device comprising:

storage means that stores data representing an original time-stretched-pulse signal;

control means that generates an expanded time-stretched-pulse signal and outputs the expanded time-stretched-pulse signal to the system, wherein the control means generates the expanded time-stretched-pulse signal by up-sampling the original time-stretched-pulse signal by a factor of K, wherein the original time-stretched-pulse signal has a period length n, and the expanded time-stretched-pulse signal has a period length n×K; and acquisition means that analyzes the signal output from the system and that acquires the frequency-characteristic information.

2. The frequency-characteristic-acquisition device according to claim 1, wherein the system to be measured is an acoustic-transmission system that starts from at least one speaker and ends at least one microphone;

wherein the control means transmits the expanded time-stretched-pulse signal to the speaker; and wherein the acquisition means analyzes a signal output from the microphone.

3. The frequency-characteristic-acquisition device according to claim 1, wherein the control means generates the expanded time-stretched-pulse signal by outputting each sample of the original time-stretched-pulse signal a predetermined plurality of times successively.

4. The frequency-characteristic-acquisition device according to claim 1, wherein the acquisition means acquires the frequency-characteristic information by down-sampling the signal output from the system and performing Fourier-transform processing on the down-sampled signal.

5. The frequency-characteristic-acquisition device according to claim 1, wherein the control means generates the expanded time-stretched-pulse signal using linear interpolation.

6. A frequency-characteristic-acquisition method comprising:

generating an expanded time-stretched-pulse signal by up-sampling an original time-stretched-pulse signal represented by stored data by a factor of K, wherein the original time-stretched-pulse signal has a period length n, and the expanded time-stretched-pulse signal has a period length n×K;

transmitting the expanded time-stretched-pulse signal to a system to be measured; and analyzing a signal output from the system, so as to acquire information about a frequency characteristic of the system.

7. The frequency-characteristic-acquisition method according to claim 6, wherein the system to be measured is an acoustic-transmission system that starts from at least one speaker and ends at least one microphone;

wherein the transmitting comprises transmitting the expanded time-stretched-pulse signal to the speaker; and wherein the analyzing comprises analyzing a signal output from the microphone.

8. A sound-signal-processing device comprising:

reproduction means that reproduces a sound signal to be output from a speaker;

storage means that stores data representing an original time-stretched-pulse signal;

control means that generates an expanded time-stretched-pulse signal and outputs the expanded time-stretched-pulse signal from the speaker, wherein the control means generates the expanded time-stretched-pulse signal by up-sampling the original time-stretched-pulse signal by a factor of K, wherein the original time-stretched-pulse signal has a period length n, and the expanded time-stretched-pulse signal has a period length n×K;

acquisition means that acquires information about a frequency characteristic of an acoustic-transmission system that starts from the speaker and ends at a microphone, wherein the acquisition means acquires the frequency-characteristic information based on the expanded time-stretched-pulse signal filtered by the acoustic-transmission system and collected by the microphone; and sound-adjustment means that adjusts the sound signal to be output from the speaker based on analysis of the frequency-characteristic information acquired by the acquisition means.

9. A frequency-characteristic-acquisition device that inputs a time-stretched-pulse signal to a system to be measured and that acquires information about a frequency characteristic of the system based on a signal output from the system, the frequency-characteristic-acquisition device comprising:

a storage unit that stores data representing an original time-stretched-pulse signal;

a control unit that generates an expanded time-stretched-pulse signal and outputs the expanded time-stretched-pulse signal to the system, wherein the control unit generates the expanded time-stretched-pulse signal by up-sampling the original time-stretched-pulse signal by a factor of K, wherein the original time-stretched-pulse signal has a period length n, and the expanded time-stretched-pulse signal has a period length n×K; and an acquisition unit that analyzes the signal output from the system and that acquires the frequency-characteristic information.

10. A sound-signal-processing device comprising:

a reproduction unit that reproduces a sound signal to be output from a speaker;

a storage unit that stores data representing an original time-stretched-pulse signal;

a control unit that generates an expanded time-stretched-pulse signal and outputs the expanded time-stretched-pulse signal from the speaker, wherein the control unit generates the expanded time-stretched-pulse signal by up-sampling the original time-stretched-pulse signal by a factor of K, wherein the original time-stretched-pulse signal has a period length n, and the expanded time-stretched-pulse signal has a period length n×K;

an acquisition unit that acquires information about a frequency characteristic of an acoustic-transmission system that starts from the speaker and ends at a microphone, wherein the acquisition unit acquires the frequency-characteristic information based on the expanded time-stretched-pulse signal filtered by the acoustic-transmission system and collected by the microphone; and a sound-adjustment unit that adjusts the sound signal to be output from the speaker based on analysis of the frequency-characteristic information acquired by the acquisition unit.

* * * * *